US005235754A

United States Patent [19]

Sirois

[11] Patent Number: 5,235,754

[45] Date of Patent: Aug. 17, 1993

[54] BEAM COMPASS

[76] Inventor: Toby Sirois, 92 Boston Post Rd., Wayland, Mass. 01778

[21] Appl. No.: 964,749

[22] Filed: Oct. 22, 1992

[51] Int. Cl.[5] ..... B43L 9/04

[52] U.S. Cl. ..... 33/27.03; 33/27.01

[58] Field of Search ..... 33/27.01, 27.02, 27.03

[56] References Cited

U.S. PATENT DOCUMENTS

| | | | |
|---|---|---|---|
| 730,742 | 6/1903 | Byrne . | |
| 957,238 | 5/1910 | Murphy . | |
| 1,296,377 | 3/1919 | Finstad | 33/27.03 |
| 1,352,320 | 9/1920 | Souders . | |
| 1,619,392 | 3/1927 | Akashi | 33/27.03 |
| 1,619,750 | 3/1927 | Nelson . | |
| 2,385,723 | 9/1945 | Oehrli | 33/27.03 |
| 2,489,061 | 11/1949 | Thompson | 33/27.03 |
| 3,293,754 | 12/1966 | Lenzini et al. | 33/27.03 X |
| 3,547,424 | 12/1970 | Brown | 33/27.03 X |

FOREIGN PATENT DOCUMENTS

| | | | |
|---|---|---|---|
| 0033589 | 6/1905 | France | 33/27.03 |

*Primary Examiner*—William A. Cuchlinski, Jr.
*Assistant Examiner*—Alvin Wirthlin
*Attorney, Agent, or Firm*—Samuels, Gauthier & Stevens

[57] ABSTRACT

A beam compass including a hollow beam, two implement securing units, and a slot communicating with the interior of the beam and extending along at least a portion of the length of the beam and away from the first implement securing unit. At least one of the implements is releasably secured to the beam at a selected location along the slot by means of a second securing unit which includes an interior portion inside the beam and an exterior portion outside the beam. The interior portion and the exterior portion are connected through the slot and cooperate to releasably secure the implement at a desired location along the slot.

11 Claims, 2 Drawing Sheets

BEAM COMPASS

BACKGROUND OF THE INVENTION

The present invention relates to beam compasses for drafting, and specifically relates to inexpensive yet reliable beam compasses.

Beam compasses typically have two implement holders: a writing implement holder for securing a writing implement such as a pencil, and a compass point holder for securing a compass point tool. Reliable beam compasses typically have writing implements and adjustable compass point tools which remain firmly in place during use. If the compass point tool, or the writing implement, were to loosen during use, the compass would be inaccurate and unreliable. As a result of this need for stability, present beam compasses are typically complex and involve a relatively large number of small moving parts. Not only are some of these compasses difficult to use, but they are also expensive to fabricate. The expense is due largely to the number of component parts in each compass as well as the complexity of precision fabrication.

Inexpensive beam compasses typically have fewer components and are thus relatively less expensive to fabricate than expensive beam compasses. Inexpensive beam compasses, however, tend to be unreliable due to the few moving components eventually loosening with respect to one another. For example, adjustable components which move by overcoming a small amount of friction may tend to loosen and separate, and adjustable components which rely on set screws may tend to loosen and wobble.

There is a need therefore for an adjustable beam compass which is reliable yet inexpensive to fabricate.

SUMMARY OF THE INVENTION

The present invention provides a beam compass including a hollow beam and a sliding releasably securable implement holder. The releasably secured implement holder secures a compass point tool in the illustrated embodiments, yet could secure a writing implement in alternative embodiments. The adjustable implement holder includes an inner portion inside the beam, and an outer portion outside the beam. The inner and outer portions cooperate to engage portions of the beam surfaces securing the implement holder at desired locations. The inner and outer portions are connected through a longitudinal slot along the length of the beam.

The securing method of the invention may be employed using various adjusting means for controlling the engagement of the releasably securable implement holder.

BRIEF DESCRIPTION OF THE DRAWINGS

The present invention may be further understood with reference to the accompanying drawings in which.

DETAILED DESCRIPTION

Figure 1:
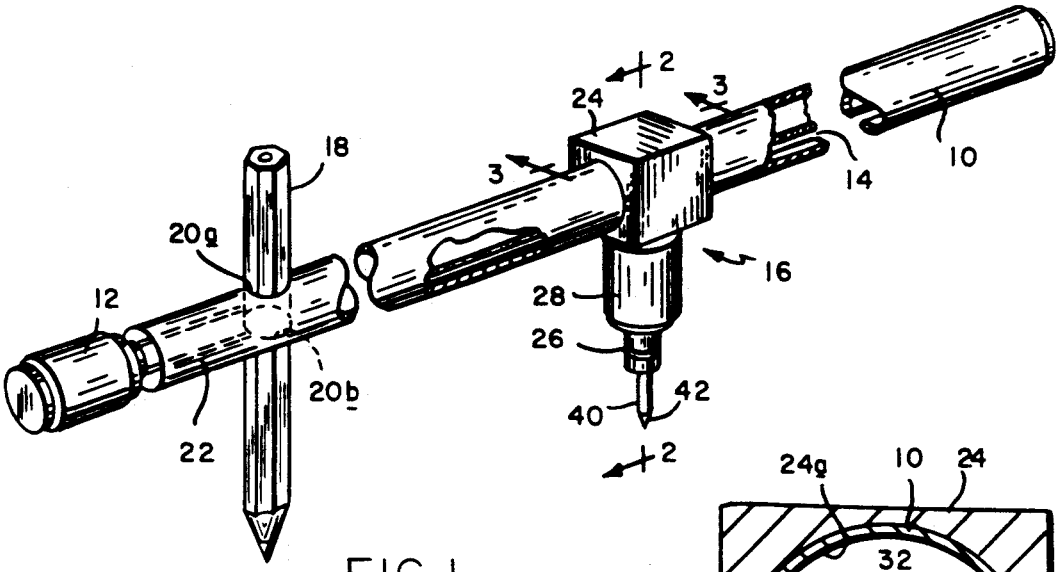
FIG. 1 is an isometric view of a beam compass of the present invention.

With reference initially to FIG. 1, a beam compass according to the invention is shown having a beam 10, a writing implement holder 12, a slot opening 14, and a compass point holder 16. The writing implement holder 12 secures a writing implement 18. As shown in FIG. 1, the writing implement 18 is mounted through holes 20*a* and 20*b*, and held in place by the distal end of threaded portion 22 of the writing implement holder 12.

Figure 2:
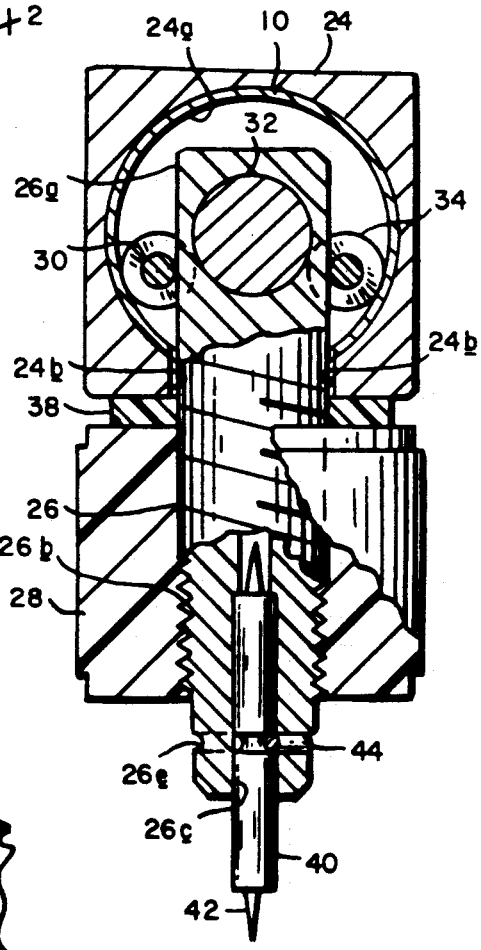
FIG. 2 is a cross-sectional view on an enlarged scale taken along line 2—2 of the beam compass shown in FIG. 1.
Figure 3:
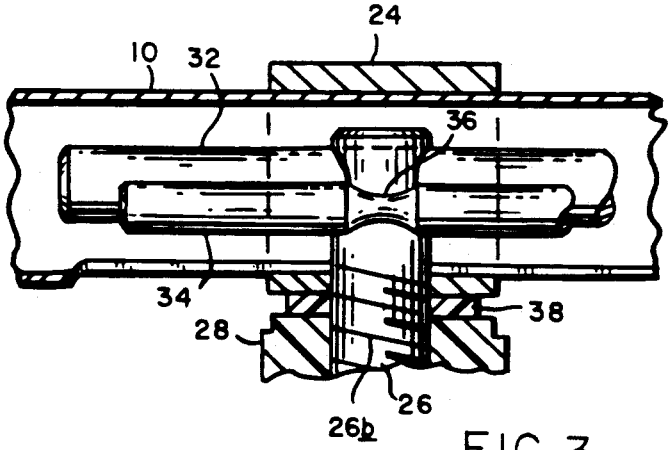
FIG. 3 is a partial longitudinal cross-sectional view taken along line 3—3 of FIG. 1.

As can be seen in FIG. 2, the compass point holder 16 includes a housing 24, a compass point tool 26 and a collar 28. Housing 24 has a throughbore 24*a* dimensioned to slidably accept the beam 10. An aperture 24*b* in the bottom of housing 24 communicates with the slot 14 in the beam and with the throughbore 24*a*. As shown in FIGS. 2 and 3, inner rod members 30, 32, and 34 extend within the beam 10 in parallel relationship with its longitudinal axis. Rod member 32 extends through and is fixed relative to the head 26*a* of compass point tool 26. Rod members 30, 34 are grooved as at 36 to contact portions of the outer surface of the head 26*a*. Compass point tool 26 is threaded as at 26*b* to coact in threaded engagement with the collar 28. A non-metallic washer 38 is interposed between the collar 28 and the housing 24. In alternative embodiments, a spring washer could be used in place of the non-metallic washer 38. The compass point tool 26 includes as opening 26*c* and a cavity 26*d* for receiving an interchangeable implement 40 containing one or two interchangeable implement points 42. The interchangeable implement 40 is secured by the spring clip 44 which is received in groove 26*e* of the compass point tool 26. In alternative embodiments, the compass point tool may not include an interchangeable implement 40. In such an alternative embodiment the compass point tool might itself form a point.

When the collar 28 is tightened, the rod 32 is pulled downwardly towards the slot 14, thereby forcing the rods 30, 34 radially outwardly against the inside surface of the beam. This securely fixes the unit 16 at a desired location along slot 14. When the collar 28 is loosened, pressure on the rods 30, 34 is relaxed, allowing the unit 16 to slide along the beam 10 to another location. The rods 30, 34 which are grooved as at 36 to coact in mechanical engagement with the outer surface of head 26*a*, slide along the beam 10 with the head 26*a* and its integral rod 32. Although the rods 30, 34 are not attached to the head 26*a*, they remain in contact with the head 26*a* as the compass point tool 26 is moved along the beam 10.

During use a writing implement 18 is placed through holes 20*a* and 20*b*. The writing implement 18 is secured at a desired position by turning the threaded portion 22 of the writing implement holder 12 such that the distal end of the writing implement holder 12 presses firmly against the writing implement 18. In the preferred embodiment the writing implement 18 is a pencil, and the pencil should extend from the beam 10 the same distance as does the compass point tool 26. In alternative embodiments these distances need not be the same and may result in a beam which is not parallel to the writing surface. The collar 28 of the compass point holder 16 may then be adjusted allowing engagement of the compass point tool at desired locations along beam 10.

In the present embodiment the beam 10 is tubular and has a length of approximately 24 inches. The inner rod members 30, 32, and 34 each have lengths of approximately 2½ inches. Because the inner rod members 30 and 34 are in contact with their respective lengths of the inner surface of the beam 10, the resulting engagement when the securing unit 36 is engaged in both stable and non destructive of the inner surface of the beam 10.

The beam compass of the present invention is inexpensive to construct yet provides a stable and reliable compass point engagement. The inner rod members 30 and 34 of the present embodiment are not attached to the inner rod member 32 or to the compass point tool 26. In alternative embodiments they could be attached and the entire inner portion of the compass point holder 16 could be attached to the compass point tool 26. In other embodiments the adjusting means for adjusting the relative positions of the inner and outer portions of the compass point holder could include a locking means for securely locking the holder into position for extended periods of time.

Moreover, in further embodiments the inner portion of the compass point holder could engage the longitudinal portion of the inside surface of the beam facing the slot. In such an embodiment the outer portion of the compass point holder could be forced against the outside surface of the beam opposite the slot so as to engage and secure the compass point tool.

The beam 10 of the present embodiment is tubular-shaped having a circular cross-section. In alternative embodiments the beam could have a square or triangular cross-section. In such alternative embodiments, the inner portion of the compass point holder should contact a sufficient portion of the adjacent inside surface of the beam for proper engagement. Likewise, the outer portion of the compass point holder should contact a sufficient portion of the adjacent outside surface of the beam to secure the compass point.

The housing 24 of the first embodiment encircles the beam 10. In alternative embodiments the outer portion need only contact the portion of the outside surface of the beam to cooperate with the inner portion and the securing unit to engage the compass point tool at a desired location along the slot.

Figure 4:
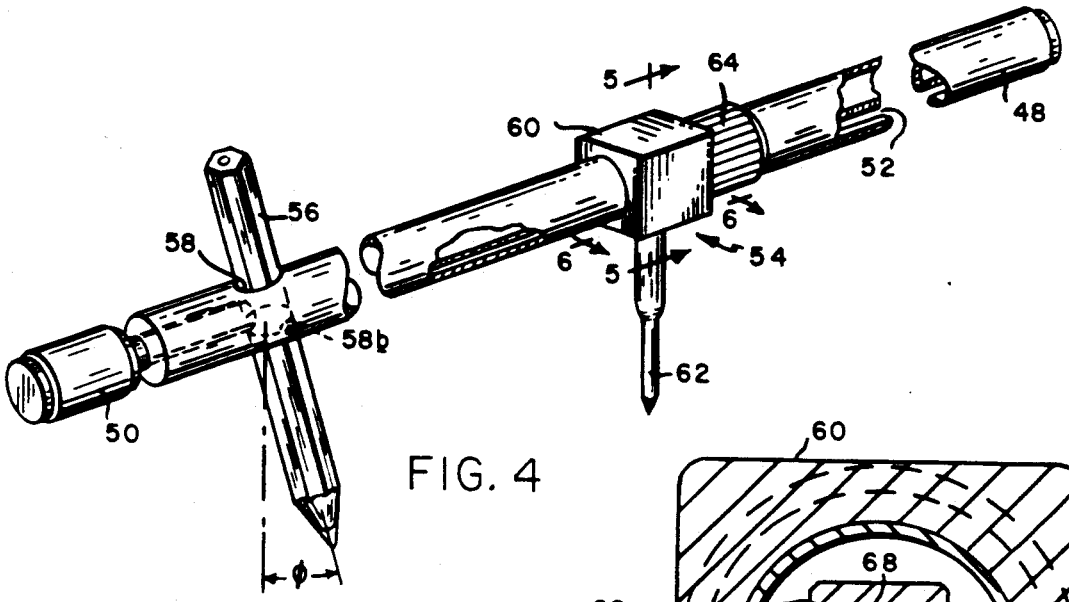
FIG. 4 is an isometric view of a second embodiment of a beam compass of the present invention.
Figure 5:
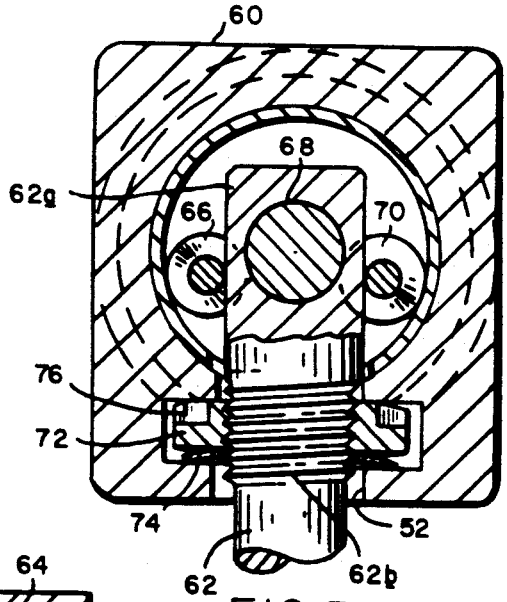
FIG. 5 is a cross-sectional view on an enlarged scale taken along line 5—5 of the beam compass shown in FIG. 4.
Figure 6:
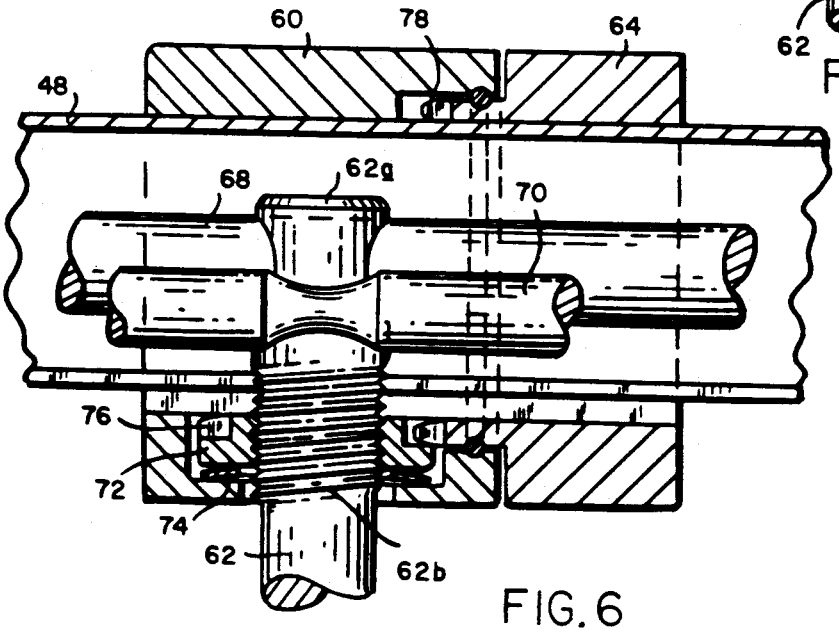
FIG. 6 is a partial longitudinal cross-sectional view taken along line 6—6 of FIG. 4.

FIGS. 4–6 show a second embodiment of the invention having an alternative apparatus for securing the compass point. With reference initially to FIG. 4, a beam compass of this second embodiment is shown having a beam 48, a writing implement holder 50, a slot opening 52, and a compass point holder 54. The writing implement holder 50 cooperates with a writing implement 56 in an arrangement similar to that described above with reference to the writing implement holder 12 and the writing implement 18. In this embodiment, however, the holes 58*a*, 58*b* are offset such that the writing implement 56 extends from the beam 48 at an angle $\phi$ from vertical as indicated in FIG. 4. This offset further enhances the stability of the beam compass.

As shown in FIGS. 5 and 6, compass point holder 54 includes a a housing 60, a compass point tool 62 and a collar 64. Unlike in the previous embodiment in which the collar 28 encircles the compass point tool 26, the collar 54 encircles the beam 48. The housing 60, the slot 52, and the rods 66, 68, 70 each generally cooperate as described above with reference to the housing 24, the slot 14, and the rods 30, 32, 34 of the previous embodiment.

The compass point holder 46 of the present embodiment further includes a nut 72 as well as a spring washer 74. The compass point tool 62 includes a head 62*a* inside the beam 48, and a threaded portion 62*b* which coacts in threaded engagement with the nut 72. The spring washer 74 is interposed between the nut 72 and the housing 60 to provide a workable resistance therebetween. The peripheral surface of the nut 72 defines gear teeth 76. The collar 64 includes gear teeth 78 along its circumferential surface adjacent the housing 60. The gear teeth 78 of the collar 64 coact in rotational engagement with gear teeth 76 of the nut 72.

When the collar 64 is tightened, the gear teeth 78 engage with the gear teeth 76 of the nut 72 and cause the nut 72 to rotate such that the rod 68 is pulled downwardly towards the slot 52, thereby forcing rods 66, 70 radially outwardly against the inside surface of the beam 48. The unit 54 is thus securely fixed at a desired location along the beam 48. As the unit 54 is moved along the slot 52 when the collar 64 is loosened, grooves on rods 66,70 coact with the outer surface of head 62*a* as described above with regard to the first embodiment.

Figure 7:
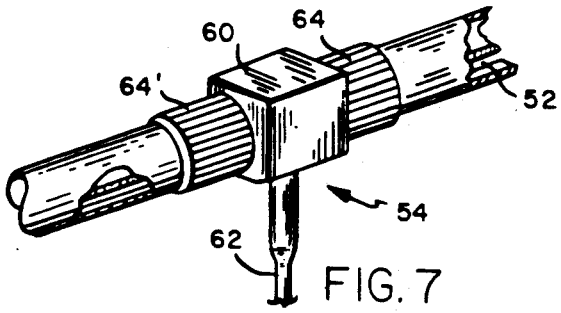
FIG. 7 is a partial isometric view of a third embodiment of the invention.

In an alternative embodiment, the beam compass could include a second collar 64 on the opposite side of the housing 60 as shown in FIG. 7. The second collar 64 could be similar to collar 64 as described above, where gear teeth on the second collar 64 would engage the gear teeth on the nut 72 from the opposite side. This would permit the compass point holder to be adjusted from either side of the housing 60, and would result in a beam compass which may be more easily adjusted during use.

In other embodiments the compass point tool could be mounted at a fixed location, and the writing implement could be releasably slidably mounted with use of an implement holder of the invention having cooperating inner and outer portions. The writing implement holder and the compass point holder both have threaded portions in the above-described embodiments. Alternatively, either of these could be mounted by any conventional securing means. Those skilled in the art will appreciate that numerous modifications may be made without departing from the scope of the invention.

I claim:

1. A beam compass comprising:

a hollow elongated beam;

first securing means for securing a first implement on said beam at a first location along the length thereof;

a slot communicating with the interior of said beam and extending along at least a portion of the length thereof and away from said first location; and second securing means for releasably securing a second implement on said beam at a selected location along said slot, wherein said second securing means comprises:

an interior portion inside said beam and an exterior portion outside said beam, said interior portion and said exterior portion being connected through said slot and cooperating to releasably secure said implement at a desired location along said slot; and adjusting means for adjusting the relative positions of said interior portion and said exterior portion such that said interior portion is urged against the inside surface of said beam and said exterior portion is urged against the outside surface of said beam.

2. A beam compass as claimed in claim 1, wherein said interior portion includes a center member connected to said second implement, and two stabilizing members in communication with said center member.

3. A beam compass as claimed in claim 3, wherein each stabilizing member contacts at least two points on the interior surface of said beam.

4. A beam compass as claimed in claim 2, wherein said stabilizing members each include grooves for coacting with said second implement such that said stabilizing members remain adjacent to said second implement as said second implement is moved along said beam.

5. A beam compass as claimed in claim 1, wherein said first implement is a writing tool and said second implement is a compass point tool.

6. A beam compass as claimed in claim 1, wherein said hollow elongated beam is tubular.

7. A beam compass as claimed in claim 1, wherein said adjusting means comprises a first rotating unit for rotating about said beam and wherein said relative position of said interior and exterior portions are caused to be adjusted when said rotating unit is rotated.

8. A beam compass as claimed in claim 7, wherein said adjusting means further comprises a second rotating unit for rotating about said beam such that said relative position of said interior and exterior portions are caused to be adjusted when either of said rotating units is rotated.

9. A beam compass as claimed in claim 1, wherein said first securing means secures said first implement in a directional position which is not normal to said beam.

10. A beam compass as claimed in claim 1, wherein said second implement further includes a releasably engaging implement unit assembly for releasably engaging an implement unit.

11. A beam compass as claimed in claim 1, wherein said second securing means further includes spring biasing means for urging said exterior portion against the outside surface of said beam.

* * * * *